United States Patent [19]

Gobert

[11] 4,118,302

[45] Oct. 3, 1978

[54] CATHODE STRUCTURE FOR USE IN ELECTROLYTIC PROCESS

[75] Inventor: Robert R. Gobert, Michigan City, Ind.

[73] Assignee: National Steel Corporation

[21] Appl. No.: 823,441

[22] Filed: Aug. 10, 1977

[51] Int. Cl.[2] ..... C25B 9/00; C25B 17/00

[52] U.S. Cl. ..... 204/206; 204/263

[58] Field of Search ..... 204/206, 263

[56] References Cited

U.S. PATENT DOCUMENTS

| | | | |
|---|---|---|---|
| 2,265,645 | 12/1941 | Johnson et al. | 204/257 |
| 2,556,017 | 6/1951 | Vonada | 204/141 |
| 2,569,578 | 10/1951 | Rieger | 204/206 |
| 3,804,739 | 4/1974 | Bergeron | 204/266 |
| 3,880,744 | 4/1975 | Idstein | 204/206 |
| 3,901,771 | 8/1975 | Froman et al. | 204/28 |
| 3,945,892 | 3/1971 | James et al. | 204/1 R |
| 3,959,099 | 5/1976 | Froman et al. | 204/146 |
| 3,988,216 | 10/1971 | Austin et al. | 204/28 |

*Primary Examiner*—R. L. Andrews

*Attorney, Agent, or Firm*—Shanley, O'Neil & Baker

[57] ABSTRACT

A cathode structure for use in an electrolytic process in which the article or material to be treated is passed between an anode immersed in an anolyte solution and a cathode immersed in a catholyte solution separated from the anolyte solution by an ion-permeable membrane. The cathode structure includes means for flowing the catholyte solution over the charged cathode surface at a rate sufficient to remove gas which is evolved on the surface and to control the temperature of the solution to protect the membrane separating the two electrolytic solutions.

20 Claims, 6 Drawing Figures

CATHODE STRUCTURE FOR USE IN ELECTROLYTIC PROCESS

BACKGROUND OF THE INVENTION

1. Field of the Invention

This invention relates to a cathode for use in an electrolytic process, and more particularly to an improved cathode structure for use in an electrolytic process in which the anode and cathode are separated by an ion-permeable membrane. The cathode structure is especially well-adapted for use in an apparatus for the production of galvanized metal sheet or strip material having a zinc coating on one side only.

2. Description of the Prior Art

Electrochemical or electrolytic processes, and apparatus for their performance, are known in which anode and cathode means are immersed in anolyte and catholyte solutions, respectively, with the solutions being confined to contiguous chambers separated by an ion-permeable wall or membrane. It is also known to flow the anolyte and catholyte solutions through their separate chambers, one such apparatus being shown, for example, in U.S. Pat. No. 3,945,892, in which a bed of anode particles is fluidized by the upward flow of anolyte solution through the anode chamber. The cathode compartment is separated from the particulate anode by a semipermeable membrane, and means are provided for increasing the pressure in the cathode compartment to equalize the increased hydrostatic pressure required to produce the flow through the particulate anode and to thereby avoid rupturing the membrane.

A method of producing galvanized metal or sheet material having a zinc coating on one side only is disclosed in U.S. Pat. No. 3,988,216, which is assigned to the assignee of this invention. According to this patent, a strip of metal which has been previously coated on both sides by hot dipping or other suitable process is drawn through an electrolyte bath between an anode immersed in the bath and a cathode immersed in an electrolyte solution which is kept separated from the anode bath solution by a perm-selective anion membrane. By applying negative current to the cathode and positive current to the anode, zinc is removed from the side of the strip facing the cathode and a substantially equal amount of zinc is simultaneously plated onto the side facing the anode.

In the production of galvanized sheet or strip steel, including one-side galvanized strip produced according to the method of U.S. Pat. No. 3,988,216, relatively high current densities are required in order to plate the strip as it is drawn through the apparatus at a commercially acceptable rate. Further, the strip may be up to 6 feet or more in width, with the anode and cathode having surface areas facing the strip of up to 50 square feet or more. With current densities of up to 1000 amperes per square foot (asf) employed, a substantial amount of heat is generated which heats the electrolyte solutions in which the anode and cathode are immersed. Since the anion membranes conventionally used in such devices are formed from a thin, delicate sheet material such as a thermoplastic synthetic resin material, the heat in the catholyte solution surrounding the cathode presents serious problems in utilizing the method on a commercial scale for producing galvanized sheet steel.

In the process of producing one-side galvanized strip steel in which the anode is immersed in an acidic electrolyte solution, or anolyte, and the cathode in a basic electrolyte solution, or catholyte, zinc coating on the side of the strip adjacent the cathode is oxidized to zinc ions which go into solution, while a substantially equivalent amount of zinc ions are reduced to zinc metal and deposited from the solution on the side of the strip facing the anode. Water disassociates at the anode and the cathode, with hydroxyl ions and hydrogen gas being generated at the cathode and hydrogen ions and oxygen gas being generated at the anode. The hydroxyl ions carry the electrocurrent through the perm-selective anion membrane and reunite with the hydrogen ions to re-form water. However, the hydrogen gas generated at the surface of the cathode tends to interfere with the electrolytic action when permitted to accumulate and form bubbles on the surface of the cathode.

In view of the foregoing, it is a primary object of the present invention to provide an improved cathode structure for use in an electrolytic process.

It is a further object of the invention to provide an improved cathode structure for use in an electrolytic process in which the anode and cathode are immersed in separate electrolytic solutions separated by an ion-permeable membrane.

Another object of the invention is to provide an improved cathode structure for use in the production of one-side galvanized sheet or strip metal material.

Another object of the invention is to provide such a cathode structure having means for circulating an electrolyte solution over the surface of the cathode at a rate sufficient to effectively cool the cathode and to flush hydrogen gas from the cathode surface.

SUMMARY OF THE INVENTION

In the attainment of the foregoing and other objects and advantages, an important feature of the invention resides in providing a cathode structure including a frame supporting a membrane defining one wall of a relatively thin box-like cathode chamber, with a cathode plate structure supported within the chamber having a flat active cathode surface in closely-spaced relation to the membrane. The frame includes conduit means for flowing a catholyte solution into the chamber adjacent the bottom thereof and removing the solution from the top of the chamber. The solution flows upwardly through the chamber at a relatively high rate between the surface of the membrane and the active surface of the cathode which faces the anode to thereby remove hydrogen gas evolved during the electrolytic process and to cool the cathode and membrane structure. The membrane is reinforced to avoid excessive deformation by the catholyte solution flowing upwardly through the cathode structure.

BRIEF DESCRIPTION OF THE DRAWINGS

The foregoing and other features and advantages of the invention will become more apparent from the detailed description contained herein, taken in conjunction with the drawings, in which.

DESCRIPTION OF THE PREFERRED EMBODIMENTS

Figure 4:
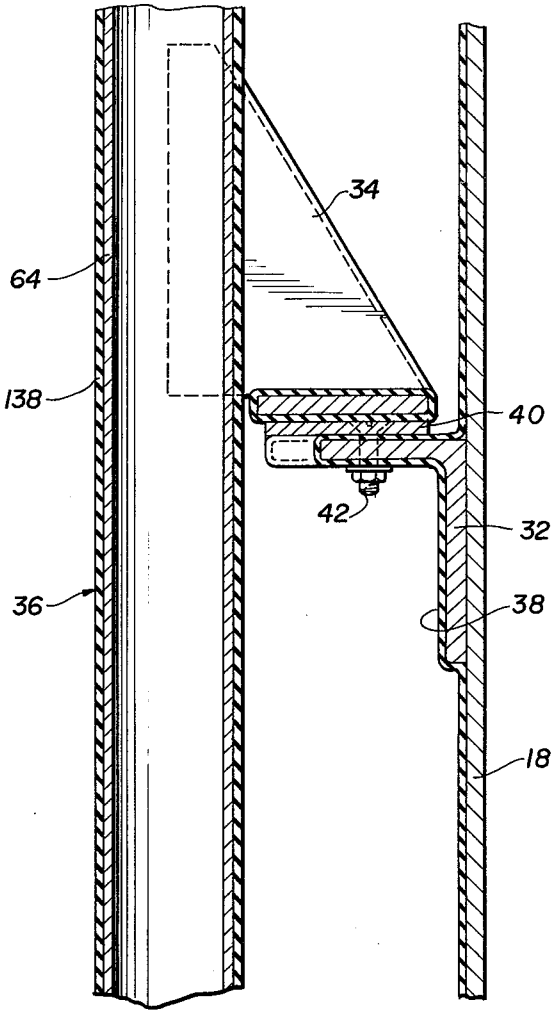
FIG. 4 is a fragmentary sectional view, on an enlarged scale, of a portion of the structure shown in FIG. 2.

Referring now to the drawings, an electroplating apparatus of the type used in coating steel strip is indicated generally by the reference numeral 10 and includes an electrolyte tank 11 defined by end walls 12, 14, side walls 16, 18, and a bottom wall 20. A movable top cover 22 may be positioned over the top of the tank where necessary. The strip 24 to be coated passes above the top of the end wall 12 and is guided in a fixed path through an electrolyte solution in the tank by three spaced, parallel guide rolls 26, 28, 30. Rolls 26 and 30 are mounted adjacent the top of the tank, near end walls 12 and 14, respectively, while roll 28 is mounted adjacent the bottom wall of the tank. Rolls 26 and 30 are spaced apart a distance substantially equal to the diameter of roll 28 so that strip 24 entering the tank above end wall 12 passes over roll 26 then vertically down through the tank around roll 28 and vertically up and over roll 30 to exit above wall 14.

The side walls 16 and 18 each have a structural angle 32 rigidly welded on their inner surface, with one leg of the angles 32 projecting inwardly and forming a horizontal ledge for engaging a bracket 34 to provide vertical support for the cathode structure or assembly 36 and for an anode assembly 37. The interior surface of the tank, including the walls and support brackets, is coated with a rubber-like material 38 which acts both as an electrical insulation and as a sealant to protect the interior walls of the tank against corrosive action of the electrolyte solution in the tank. A synthetic resin pad 40 is positioned on the top surface of the angles 32 and retained in place by bolt assemblies 42 formed from a synthetic resin material not affected by the electrolyte solution.

A pair of structural angle members 44, 46 are rigidly mounted on each of the walls 16, 18, in vertically spaced relation to one another and beneath the angle 32, with one leg of each angle extending inwardly into the tank. A cathode guide assembly is mounted between the pairs of angles 44, 46 on each of the walls 16, 18, with the respective guide assemblies each including a pair of vertically extending, laterally spaced, parallel guide members 48, 50 rigidly welded, at their top and bottom, respectively, to angle brackets 52, 54. The angle brackets 52, 54, are each provided with an elongated slot 56 through which a pair of synthetic resin bolt assemblies 58 extend to clamp the bracket 54 to the inwardly projecting horizontal leg of angles 44, 46. Synthetic resin spacers 60 are provided between the angle brackets 52, 54 and the structural members 44, 46, respectively.

The cathode assembly constitutes a thin, generally rectangular, vertically-extending reservoir for a catholyte solution, with the reservoir being submerged in the anolyte solution in the main tank 11 of the electroplating apparatus 10. The catholyte solution is separated from the anolyte solution by an ion-permeable membrane described hereinbelow and extending over a major portion of the front surface of the catholyte reservoir, i.e., the surface facing the anode 37, when the cathode assembly is installed in the apparatus. The cathode assembly 36 comprises a generally rectangular outer frame made up of four elongated pipe sections, including a top section 62, two side sections 64, 68, and a bottom section 66, rigidly joined as by welding, using ells 70 and a T 72 at the corners of the frame. The T-fitting 72 joins the pipe members 62 and 68 and also provides an inlet for fluid into the frame, as indicated by the arrow 74. A pair of elongated vertically-extending bar members 76 having a rectangular cross-section are rigidly welded one to the outer edge of each of the pipe sections 64 and 68 and extend along a major portion of the length of these pipe sections from a point adjacent the bottom thereof. The bars 76 are dimensioned to be received between the guide 48, 50 which act as vertical guide tracks to position the cathode assembly 36 in the tank in vertically-extending parallel relation to the flat plate anode assembly 37.

A horizontal flat top plate member 78 extends between and has its ends rigidly welded to the pipe sections 64 and 68 at points approximately two-thirds their length above bottom pipe section 66. A pair of vertically-extending side plate members 80 are rigidly welded, one to each of the pipe sections 64 and 68 on the inner peripheral surface thereof and extend downward from the top plate member 78 to the bottom pipe section 66. The two side plate members 80 and the top plate 78 cooperate with the bottom pipe member 66 to define, in effect, a rectangular frame for a cathode plate 82. Cathode plate 82 can be a steel plate which is substantially rectangular in front elevation view and welded in fluid-tight relation along its vertical side edges to the plates 80.

Cathode plate 82 is generally planar over the major portion of its surface, but has its top and bottom edge portions 84, 86, respectively, offset to the back of the assembly, i.e., offset in a direction away from the anode when the cathode is mounted in the tank of the electroplating apparatus. Edge portions 84, 86, are joined to top and bottom active body portions 88, 89 of the cathode plate 82 by integral inclined portions 90, 92, respectively. The central portion 94 of the cathode plate is also deflected rearwardly, along a horizontal line, with the central portion 94 being joined to the body sections 88, 89 by upper and lower inclined portions 96, 98, respectively.

A pair of flat back plate members 100, 102 are rigidly welded in fluid-tight relation to plate members 80 and the cathode plate member with the rearwardly facing surfaces of plates 100, 102 extending in coplanar relation with the rearwardly facing surfaces of plate portions 84, 86, and 94. The upper back plate 100 is welded to and extends between sections 84 and 94 while lower back plate 102 extends between sections 86 and 94. A plurality of baffle plates, or dividers 104, each having a plurality of openings 106 extending therethrough, are mounted between back plates 100 and 102 and the body sections 88, 89 of the cathode plate member, thereby dividing the space between body section 88, and the back plate 100, into a plurality of chambers 108, and the space between the body section 84 and back plate 102 into a plurality of chambers 110, with the openings 106 providing fluid access between adjacent chambers. In addition, each of the inclined cathode plate sections 90, 92, 96 and 98 have a plurality of openings 112 formed therein for reasons pointed out more fully hereinbelow.

A narrow plate 114 is rigidly welded to and projects downwardly from the top bar member 78 with the forward surface of plate 114 extending in a plane parallel to and recessed slightly from the forward surface of the body sections 88, 89 of the cathode plate. The lower edge of plate 114 terminates at a position spaced slightly from the juncture of the inclined section 90 with the body section 88. A similar narrow plate 116 is rigidly welded to and extends upwardly from the lower pipe section 66 along substantially its full length. Plate 116 terminates at a position spaced closely to the juncture of the inclined section 92 with the bottom body section 89. A pair of narrow flat plate members 118 are rigidly welded one to each of the vertical or side pipe segments, 64, 68, respectively, and extend between the horizontal plates 114, 116, with the plates 114, 116, 118 cooperating to define a rectangular opening or window through which the forward surface of the body sections 88 and 89 of the cathode plate project slightly.

A divider plate 120 extends between and is rigidly joined to the plates 118 at the mid-section thereof, with the plate 120 being positioned within the recessed central portion 94 of the body of the cathode plate and dividing the rectangular window into two smaller rectangular openings. Divider plate 120 divides the rectangular opening into upper and lower rectangular sections of substantially equal dimensions. The plate 120 may have reinforcing webs 122 welded to its back surface, and stabilizing posts 124 can be welded to the back of plate 120 and to the forward surface of the recessed portion 94 of the cathode plate.

Figure 6:
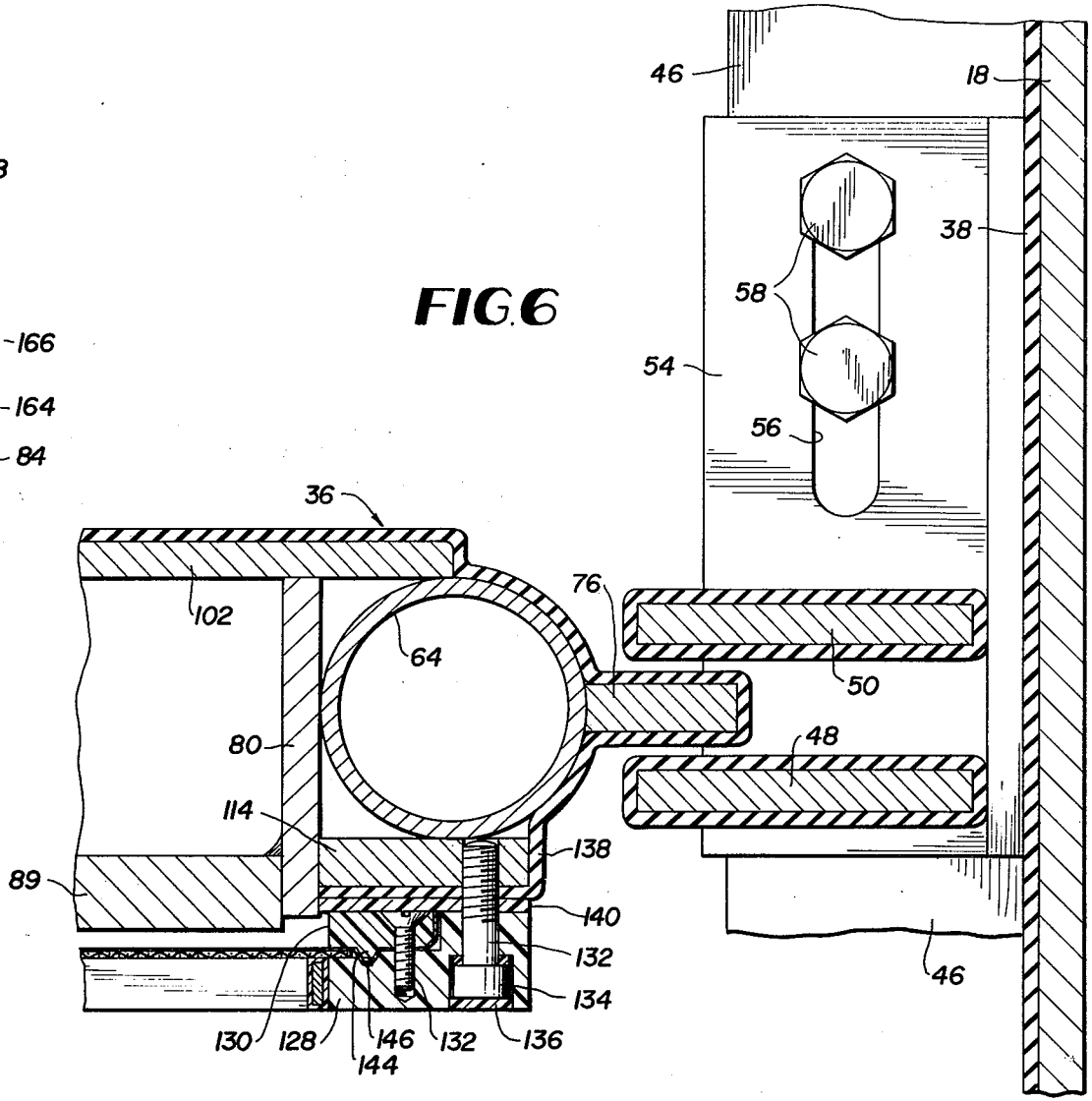
FIG. 6 is a fragmentary sectional view, on an enlarged scale, taken on line 6—6 of FIG. 5.
Figure 5:
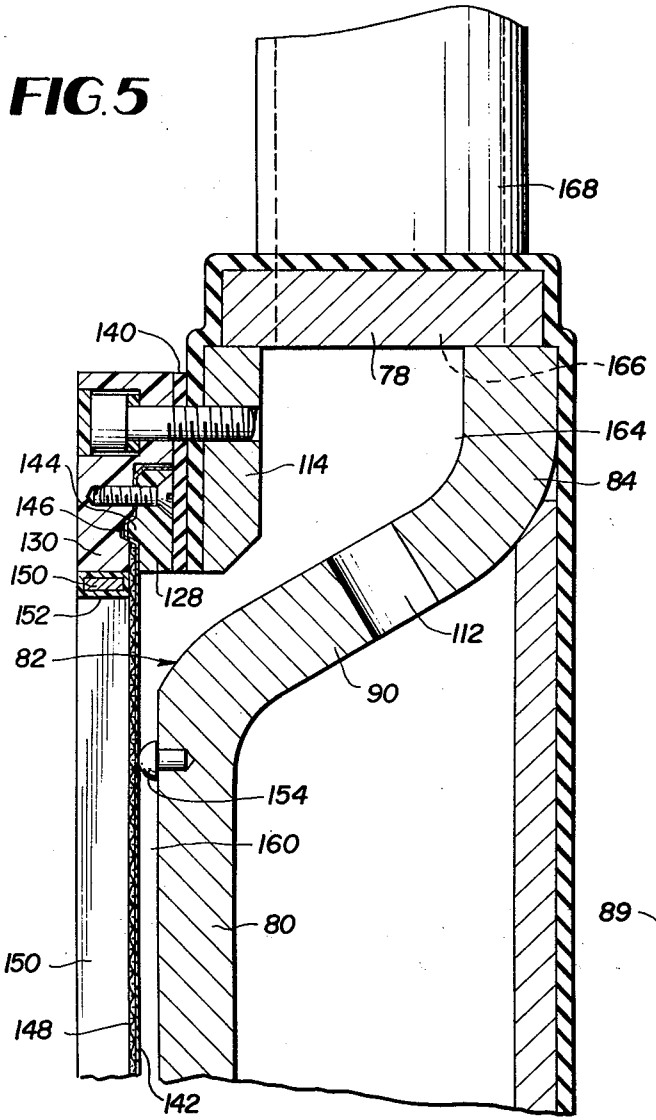
FIG. 5 is a fragmentary sectional view, on an enlarged scale, taken on line 5—5 of FIG. 2.

A pair of substantially identical open, rectangular frames 126 are mounted on the forward face of the cathode assembly and extend around the periphery of the upper and lower sections of the rectangular opening. Each of the frames 126 is made up of horizontally-extending, parallel upper and lower frame assemblies rigidly joined or integrally formed at their respective ends to vertically-extending parallel side frame assemblies, with the horizontal and vertical frame assemblies being substantially identical in cross-section. As best seen in FIGS. 5 and 6, each frame assembly consists of a pair of elongated beams 128, 130 joined by suitable fasteners such as screws 132, and the assemblies are mounted onto the forward surface of the cathode assembly around the periphery of the smaller rectangular openings. The beams 128, 130 are preferably formed from a rigid synthetic resin or similar dielectric material which is unaffected by the electrolyte solution used in the electroplating process.

Bolts 134 having their heads 135 recessed into the bars 128 and sealed by a plastic washer or disc member 136 rigidly mount the frame assemblies onto the forward surface of the cathode assembly. A layer 138 of rubber or other suitable dielectric material unaffected by the electrolyte solution is firmly bonded to and covers the exposed external metal surface portions of the cathode assembly, and this rubber layer preferably extends beneath the frames 126 to provide a positive fluid-tight seal. As shown in FIG. 5, a gasket member, or shim, 140 can also be provided between the frames and the supporting face surface of the cathode structure.

A perm-selective anion membrane 142 is supported by each of the frames 126, with the membrane having its peripheral edges firmly clamped between the frame members or frames 128, 130. To this end, the beam 128 may have a groove 144 in a surface thereof adapted to receive a complementary tongue 146 on the beam 130, with the tongue-and-groove cooperating to firmly grip the peripheral edges of the membrane 142 clamped therebetween to form a sealed catholyte chamber in the cathode assembly. Since the membrane 142 is a relatively thin, delicate membrane, it is reinforced by a layer or sheet of an open, high strength nylon mesh 148 positioned over the external surface of the membrane and stretched taut. The mesh or netting has its edges clamped between the beams 128, 130. A rigid metal grill or grid 150, having its external surface covered by a layer 152 of rubber-like dielectric material which is unaffected by the electrolyte solution, is rigidly joined, as by screws, not shown, to the inner peripheral edge of the member 128. Alternatively, the grill 150 and supporting frame structure may be integrally formed as a single structural element. Grid 150 extends over the entire opening of the frames 126 to provide support for the membrane 142 and the nylon mesh 148. The mesh 148 serves both as a reinforcement for the ion-permeable membrane and to protect the surface of the membrane from direct contact with the rigid grid 150, thereby preventing or minimizing wear and reducing stress concentrations at the points of contact with the individual structural members of the grid. Although the openings in the grid are relatively large, they are nevertheless much smaller than the total area of the membrane so that the hydrostatic load carried by the membrane as a result of fluid pressure in the cathode assembly is more uniformly distributed and the grid substantially reduces both the lateral deflection and maximum stresses in the membrane and netting as a result of fluid pressure in the cathode assembly. The grid also acts as a guard against the strip 24 coming into direct contact with the netting and membrane.

The membranes 142 extend in closely-spaced parallel relation to the forward surface of the body portions 88, 89 of the cathode plate 82. Gauge pins 154 may be provided on the forward surface of the body sections to act as a guide to provide the desired spacing between the ion-permeable membrane and the cathode surface. Gasket members 140 can be employed to provide the desired spacing.

Figure 3:
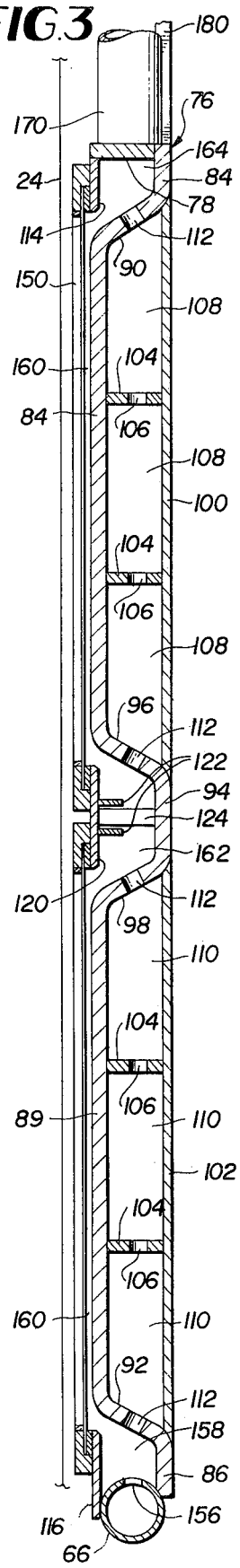
FIG. 3 is a sectional view taken on line 3—3 of FIG. 2.

Referring now to FIG. 3, the bottom pipe section 66 is provided with a plurality of openings 156 spaced along its length. Catholyte solution flowing into the cathode structure through inlet 74 is divided at the T-section 72, with a portion flowing through sections 62 and 64 to one end of the pipe section 66 and the other portion flowing through pipe section 68 to the opposite end of section 66. This solution flows through the openings 156 into an elongated horizontal chamber 158 defined by the plate section 86, the top of the pipe section 66, the flat plate 116, and the inclined portion 92 of the cathode plate structure. The catholyte solution from chamber 156 is divided, a portion flowing through openings 112 into the lowermost chamber 110, and the remainder passing through the space between the plate 116 and the cathode plate to flow upward through the narrow space or channel 160 between the ion-permeable membrane 142 and the forwardly-directly surface of the cathode body section 89. Since the channel 160 is relatively narrow, flow over the active surface of body section 89 will be relatively rapid to thereby purge, or scour away any hydrogen bubbles tending to form on the surface. The rate of flow upward through the channel 160 will vary with the pressure in the chamber 158, but since this flow path is substantially free of obstructions, a relatively high flow rate sufficient to effectively remove hydrogen gas and to cool the surface of the cathode plate can be achieved without requiring excessive pressure which might rupture the membrane.

The catholyte solution flowing through the openings 112 and upwardly through the successive chambers 110, via openings 106, can flow at a substantially slower rate, with the greater volume in the chambers 110 acting as a heat sink to absorb heat from the body section 89 of the cathode plate. The fluid flowing over the two sides of the body section 89 recombine in the central portion of the assembly, in chamber 162, when the solution flowing from the top chamber 110 exits through the opening 112 in inclined portion 98.

The fluid in the catholyte chamber is again separated in the upper segment of the cathode assembly, as a portion flows through the openings 112 in inclined plate section 96 into the lower chamber 108 and the remainder flows between the ion-permeable membrane 142 and the outer surface of the upper body section 88. The catholyte solution is again recombined at the top of the structure in chamber 164.

Figure 2:
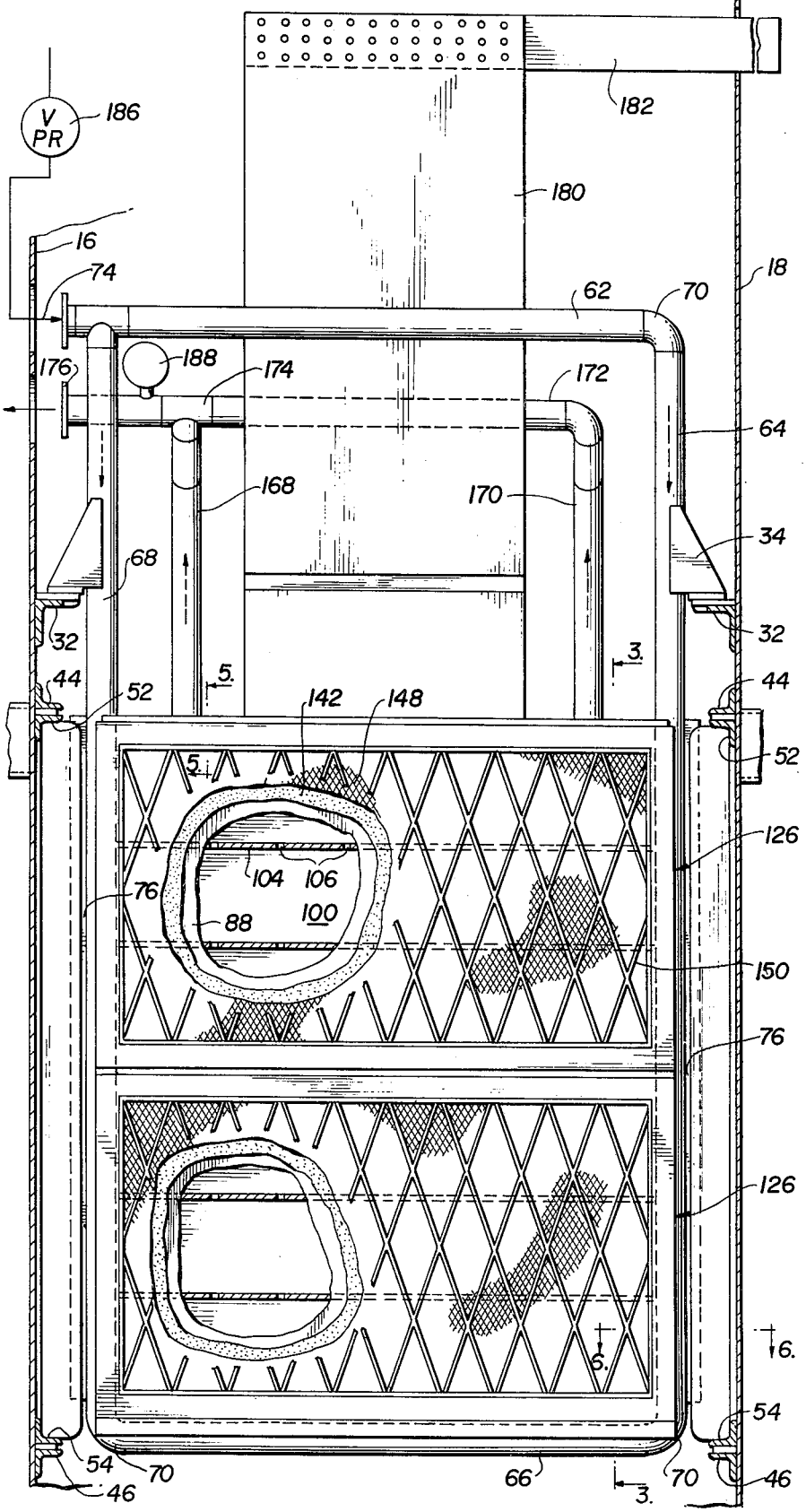
FIG. 2 is a fragmentary sectional view taken on line 2—2 of FIG. 1 and showing the cathode structure of the present invention.

As seen in FIG. 5, the catholyte solution from chamber 164 flows upward through openings 166 in top plate 78 into a pair of exhaust conduits 168, 170 which are connected by a pipe section 172 (see FIG. 2) and a T-fitting 174 which leads to a suitable flange coupling 176 to provide a return flow of the catholyte solution.

Electric current is provided to the cathode plate 82 by an upwardly-extending plate segment 180 which is connected to a suitable bus-bar 182 at a point near the top of the electrolyte tank.

Figure 1:
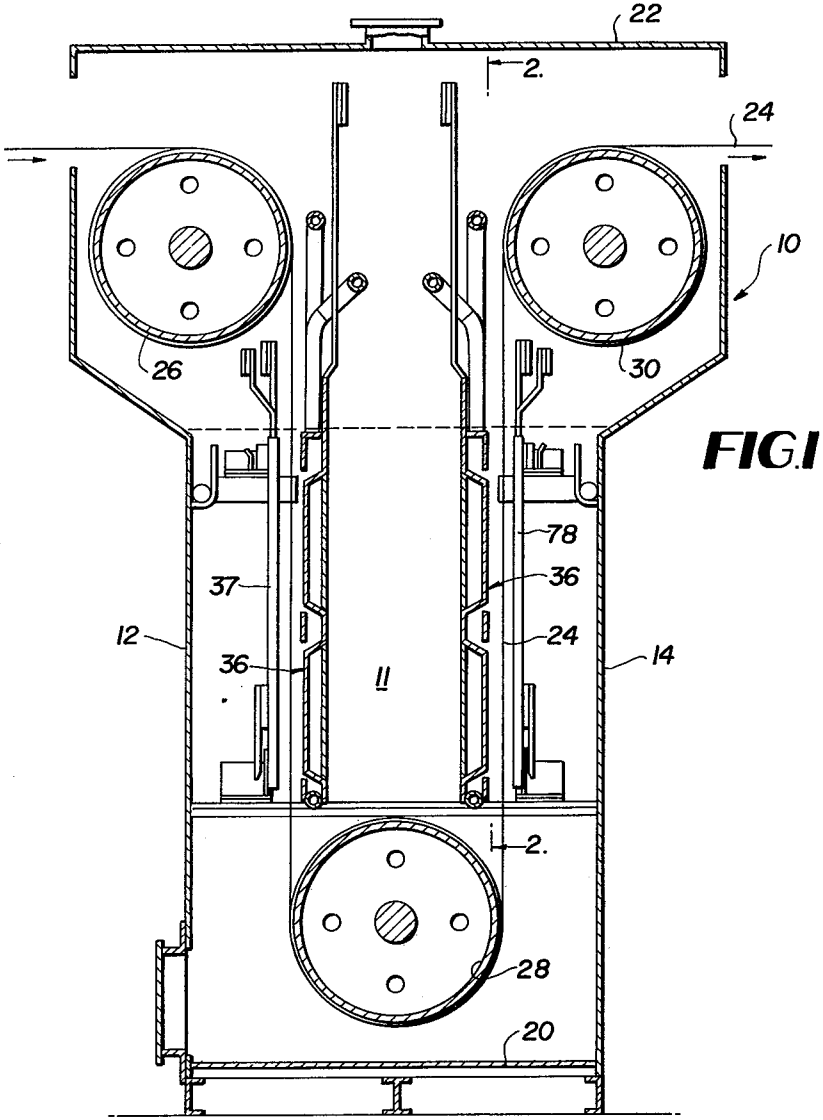
FIG. 1 is a side elevation view, in section, of an electroplating apparatus employing a cathode structure according to the present invention to process strip metal.

In the strip plating system illustrated in FIG. 1, a continuous strip of metal 24 which is to be electroplated enters the apparatus over roll 26 and passes vertically downward between a cathode assembly 36 and the opposed anode 37. At the bottom of the apparatus, the strip passes around roll 28 then vertically upward between a second cathode assembly 36 and anode 37 before passing over roll 30 and exiting the apparatus. In apparatus of this type, the strip may be passed between any number of anode-cathode pairs as required to assure complete processing of the strip at the desired rate of travel of the strip. The speed of the strip may thus be increased by duplicating the anode and cathode pairs, and providing additional rollers to guide the strip in its path between the respective pairs. The cathodes may be accurately positioned relative to the strip by adjusting the guide assemblies prior to installing the cathodes in the anolyte tank. The guide assemblies on the tank can be adjusted by the simple expedient of loosening the bolt assemblies 58 and adjusting the position of angle brackets 54 along support angles 44, 46.

During operation of the strip plating system employing the cathode structure of this invention, the tank is filled with an anolyte solution to a level above the active surface of the anode and cathode assemblies. This level is indicated by the broken line 184 in FIG. 1, and, as shown, is preferably at least slightly above the top of plates 37. The anolyte solution employed in the one-side galvanizing process employing the cathode structure of this invention may be an aqueous solution of sulfuric acid and the catholyte solution circulated through the cathode may be an aqueous solution of sodium hydroxide. Mixing of the two solutions is prevented only by the relatively thin ion-permeable membrane.

The materials most frequently used for such ion-permeable membrane are sensitive to elevated temperatures, both from the standpoint of strength and dimensional stability. To assure against damage to the membrane, it is important that the temperature of both the anolyte and catholyte solutions be maintained at a level which will not exceed the safe operating temperature for the material of the membrane used. In practice, the relatively large volume of the acid solution employed in the tank is able to absorb and disperse heat from the anode generated during the electroplating process without reaching a temperature which will adversely affect the ion-permeable membrane. However, the relatively small volume of catholyte solution in the liquid chamber of the cathode assembly can readily reach a temperature which would exceed the safe operating temperature for the membrane in the absence of some means for cooling the catholyte solution, even though the cathode is submerged in the anolyte solution, due at least in part to the heat insulation of the dielectric coating 138 covering the exposed external metal surfaces of the cathode assembly.

In the present invention, where the catholyte chamber is contained as an integral part of the cathode assembly, weight and dimensional considerations make it desirable to maintain the liquid volume of the cathode relatively low to facilitate handling the assembly. By circulating the catholyte solution over the body portions of the cathode plate from a larger source of the solution outside the apparatus, the temperature of the cathode plate, and of the solution contacting the membrane, can be maintained at a level which is sufficiently low as to not adversely affect the membrane. Means for cooling the catholyte solution outside the cathode assembly can be provided if necessary or desirable.

Circulation of the catholyte solution through the cathode assembly necessarily requires a fluid pressure on the catholyte side of the membrane which exceeds the pressure outside the anolyte side by an amount sufficient to produce the desired flow rate through the cathode chamber. The solution is supplied by a suitable pump, not shown, through a pressure regulator 186, which accurately controls the pressure of the cathode inlet to thereby provide the required solution flow rate through the chamber. The catholyte solution flows upwardly at a relatively high velocity through the channel 160 between the ion-permeable membrane and the forward surface of the cathode body sections, and at a slower rate through the fluid chambers 108 and 110. The baffle plates 104 and orifices 106 in the fluid chambers 108, 110, act as flow restrictors which assure a distribution of the liquid that will produce a sufficient flow through channel 160 to scrub or flush away any minute bubbles of hydrogen gas which tend to collect on the active surface of the body sections as a result of the electroplating process, and to assure that the temperature of this portion of the catholyte solution does not reach a temperature which could damage membrane 142. Recombining the solution flowing on the opposite sides of body section 89 in the central chamber 162 further assures against overheating the solution flowing through the upper portion of channel 160.

The relatively high strength open-mesh netting sheet 148 reinforcing the ion-permeable membrane, cooperating with the relatively coarse but rigid grid structure 150 enables the use of relatively large sheets of ion-permeable membrane without the fluid pressure within the cathode chamber rupturing the membrane. At the same time, the open mesh used, and the coarser grid, provide substantially no interference with the electroplating process. The netting material can be a nonwoven, extruded nylon or polyethylene netting which is readily available commercially.

In order to guard against mixing of an excessive amount of catholyte solution with anolyte solution in the tank in the event of the membrane rupturing, the outlet pressure in the exhaust line is continuously monitored as by a pressure transducer or gauge 188. In the event of a drop in exhaust pressure, indicating a leak of catholyte solution into the anolyte tank, the inlet can be immediately shut down, as by actuation of a quick-acting valve, not shown. The greater pressure in the cathode chamber than in the tank assures against the acid anolyte solution entering the cathode chamber and being forced out through the drain 176 when the membrane is ruptured.

While a single embodiment of the invention has been disclosed and described, it is believed apparent that various modifications might be made without departing from the invention. Thus, while the cathode assembly described is, in effect, a two-section cathode having two coplanar active body sections spaced from one another and covered by a separately-mounted ion-permeable membrane, the invention is not so limited. Further, while the cathode structure is especially well-adapted for use in a system in which the anode and cathode pairs are disposed vertically, the cathode will function equally well in a horizontal or inclined installation.

Accordingly, while I have disclosed and described a preferred embodiment of my invention, I wish it understood that I do not intend to be restricted solely thereto, but rather that I intend to include all embodiments thereof which would be apparent to one skilled in the art and which come within the spirit and scope of my invention.

I claim:

1. A cathode structure for use in an apparatus for electrolytic treatment of an elongated strip of metal in a tank containing a bath of a first electrolyte solution by drawing the strip longitudinally through the bath between a substantially flat, positively-charged anode submerged in the bath and a negatively-charged cathode, the cathode structure comprising, metal plate means having a front surface defining a generally rectangular substantially flat cathode surface and a back surface, a thin generally rectangular electrolyte chamber enclosing the metal plate means, the electrolyte chamber including spaced side walls and spaced end walls joined together to define a generally rectangular frame extending around the peripheral edges of the metal plate means and front and back wall panels mounted on the frame and extending in generally parallel spaced relation to the front and back surfaces respectively of the metal plate means, the front wall panel including a portion defined by an ion-permeable membrane extending in closely-spaced relation to the cathode surface to define a thin fluid channel extending between the membrane and the cathode surface and extending over the entire cathode surface, inlet means in the electrolyte chamber adjacent one wall of the chamber and including connector means for connection with a source of a second electrolyte solution under pressure, outlet means in the electrolyte chamber adjacent the wall opposite the inlet for permitting the second electrolyte solution to flow through the electrolyte chamber from the inlet through the outlet, flow divider means within the electrolyte chamber for dividing electrolyte solution flowing between the inlet and outlet means and directing a portion of the second electrolyte solution through the thin fluid channel and the remaining portion through the space between the back wall panel and the back surface of the metal plate means, means adjacent the outlet recombining the portions of the second electrolyte solution before the solution flows from the outlet, and means for mounting the electrolyte chamber in the first electrolyte solution within the tank.

2. The apparatus as defined in claim 1 wherein the cathode further comprises reinforcing means external of the electrolyte chamber reinforcing the ion-permeable membrane without substantially interfering with the passage of ions through the membrane.

3. The apparatus as defined in claim 2 wherein the reinforcing means comprises a sheet of synthetic resin netting material overlying the external surface of the ion-permeable membrane.

4. The apparatus as defined in claim 3 wherein the reinforcing means further comprises a metal grid having a coating of dielectric material covering and sealing the external surfaces thereof, the grid extending over the sheet of synthetic resin netting material to reinforce the netting and the ion-permeable membrane.

5. The apparatus as defined in claim 1 wherein the inlet means includes a distribution channel extending substantially along the full length of said one wall and communicating with the thin channel substantially along its full length to provide a uniform flow over the cathode surface.

6. The apparatus as defined in claim 5 wherein the means adjacent the outlet for recombining the portions of the second catholyte solution comprises an outlet channel extending substantially along the length of the wall opposite the inlet, the outlet channel communicating with the spaces along the front and back surfaces of the metal plate means.

7. The apparatus as defined in claim 6 further comprising means recombining the portions of the second electrolyte solution flowing over the front and back surfaces of the metal plate means at a point intemediate the distribution channel and the outlet channel, and means redividing the recombined solution to direct portions thereof along both the front and back surfaces of the metal plate means to the outlet channel.

8. The apparatus as defined in claim 7 wherein the means recombining the portions of the second electrolyte solutions comprises a mixing channel extending generally parallel to and spaced from the distribution and outlet channels and substantially completely across the cathode surface.

9. The apparatus as defined in claim 1 wherein the cathode further comprises reinforcing means external of the electrolyte chamber reinforcing the ion-permeable membrane without substantially interfering with the passage of ions through the membrane, and wherein the inlet means includes a distribution channel extending substantially along the full length of said one wall and communicating with the thin channel substantially along its full length to provide a uniform flow over the cathode surface.

10. The apparatus as defined in claim 9 wherein the reinforcing means comprises a sheet of synthetic resin netting material overlying the external surface of the ion-permeable membrane, and a metal grid having a coating of dielectric material covering and sealing the external surfaces thereeof, the grid extending over the sheet of synthetic resin netting material to reinforce the netting and the ion-permeable membrane.

11. The apparatus as defined in claim 10 wherein the means adjacent the outlet for rcombining the portions of the second catholyte solution comprises an outlet channel extending substantially along the length of the wall opposite the inlet, the outlet channel communicating with the spaces along the front and back surfaces of the metal plate means.

12. The apparatus as defined in claim 11 further comprising means supporting the cathode with the cathode surface extending in a vertical plane and with the end walls forming the top and bottom walls of the electrolyte chamber, the inlet means being located adjacent the bottom end wall and the outlet means being located adjacent the top end wall.

13. The apparatus as defined in claim 1 wherein the front wall panel comprises a rigid support frame extending around and supporting the peripheral edge portions of the ion-permeable membrane, and means mounting the support frame on the side and end walls of the electrolyte chamber in fluid-tight relation.

14. The apparatus as defined in claim 13 wherein the support frame has a generally rectangular central opening closed by the ion-permeable membrane, and means extending over the central opening to reinforce and support the membrane against fluid pressure within the electrolyte chamber.

15. The apparatus as defined in claim 14 wherein the reinforcing means comprises a sheet of synthetic resin netting material extending in contact with the external surface of the ion-permeable membrane, and a rigid grid mounted on the support frame and extending over the central opening reinforcing the synthetic resin netting material, the netting material preventing direct contact between the membrane and the grid.

16. The apparatus as defined in claim 1 further comprising means supporting the cathode with the cathode surface extending in a vertical plane and with the end walls forming the top and bottom walls of the electrolyte chamber, the inlet means being located adjacent the bottom end wall and the outlet means being located adjacent the top end wall.

17. The apparatus as defined in claim 16 wherein at least one of the side walls comprises first pipe means having one end adapted to be connected to a source of the second electrolyte solution and its other end connected to a second pipe means, the second pipe means extending along the bottom of the electrolyte chamber and having a plurality of openings formed therein for admitting the second electrolyte solution into the fluid chamber substantially along the full length of the bottom wall.

18. The apparatus as defined in claim 17 wherein each said side wall comprises pipe means having one end adapted to be connected to a source of the second electrolyte solution and each having their other end connected one to each end of the second pipe means.

19. An apparatus for electrolytic treatment of an elongated strip of metal comprising, a tank containing a bath of a first electrolyte solution, means for drawing the strip longitudinally through the bath between a substantially flat positively-charged anode submerged in the first electrolyte solution and a negatively-charged cathode, the cathode including metal plate means having a front surface defining a generally rectangular substantially flat cathode surface and a back surface, a thin, generally rectangular fluid chamber mounted on and enclosing the metal plate means, the fluid chamber including spaced side walls and spaced end walls joined together to define a generally rectangular frame extending around the peripheral edges of the metal plate means and front and back wall panels mounted on said frame and extending in generally parallel spaced relation to the front and back surfaces of said metal plate means, respectively, the front wall panel including an ion-permeable membrane extending in closely spaced relation to the flat cathode surface to define a narrow fluid channel between the membrane and the cathode surface, inlet means for supplying a second electrolyte solution under pressure into the chamber adjacent one wall of the chamber, outlet means adjacent the wall opposite the inlet for permitting flow of the second electrolyte solution out of the chamber, flow divider means within the chamber for directing a portion of the second electrolyte solution supplied by the inlet means through the narrow channel between the cathode surface and the ion-permeable membrane and a portion through the space between the back wall panel and the back surface of the metal plate means, and mounting means supporting the fluid chamber and the metal plate means within the tank with the cathode surface in generally parallel opposed relation to and spaced from the anode.

20. The appartus as defined in claim 19 wherein the cathode further comprises reinforcing means external of the electrolyte chamber reinforcing the ion-permeable membrane without substantially interfering with the passage of ions through the membrane, the reinforcing means including a sheet of synthetic resin netting material extending in contact with the external surface of the ion-permeable membrane, and a rigid grid mounted on the support frame and extending over the central opening reinforcing the synthetic resin netting material, the netting material preventing direct contact between the membrane and the grid.

* * * * *

UNITED STATES PATENT AND TRADEMARK OFFICE

CERTIFICATE OF CORRECTION

PATENT NO. : 4,118,302

DATED : October 3, 1978

INVENTOR(S) : ROBERT R. GOBERT

It is certified that error appears in the above-identified patent and that said Letters Patent are hereby corrected as shown below:

Column 6, line 59, "directly" should be -- directed --.
Column 11, line 2, "thereeof" should be -- thereof --;
Line 7, "rcombining" should be -- recombining--

Signed and Sealed this

*Fifth* Day of *June 1979*

[SEAL]

*Attest:*

RUTH C. MASON
*Attesting Officer*

DONALD W. BANNER
*Commissioner of Patents and Trademarks*